US005177816A

United States Patent [19]

Schmidt et al.

[11] Patent Number: 5,177,816

[45] Date of Patent: Jan. 12, 1993

[54] HELMET VISOR SUPPORT APPARATUS

[75] Inventors: Daniel J. Schmidt, Yardley, Pa.; John D. Jacks, Hendersonville, N.C.

[73] Assignee: The United States of America as represented by the Secretary of the Navy, Washington, D.C.

[21] Appl. No.: 805,281

[22] Filed: Dec. 10, 1991

[51] Int. Cl.[5] ..... A42B 3/02

[52] U.S. Cl. ..... 2/424; 2/6

[58] Field of Search ..... 2/6, 10, 424, 425, 427, 2/9, 8

[56] References Cited

U.S. PATENT DOCUMENTS

| | | | |
|---|---|---|---|
| 3,721,994 | 3/1973 | DeSimone et al. | 2/6 |
| 3,783,452 | 1/1974 | Benson et al. | 2/6 |
| 4,170,792 | 10/1979 | Higgs | 2/10 |
| 4,199,823 | 4/1980 | Jenkins | 2/424 |
| 4,292,688 | 10/1981 | Ellis | 2/6 |
| 4,621,377 | 11/1986 | Pennell | 2/6 |
| 4,802,243 | 2/1989 | Griffiths | 2/6 |
| 4,847,920 | 7/1989 | Aileo et al. | 2/424 |
| 4,885,806 | 12/1989 | Heller | 2/423 |
| 4,887,320 | 12/1989 | Long et al. | 2/424 |
| 4,907,300 | 3/1990 | Dampney et al. | 2/424 |
| 5,073,990 | 12/1991 | Kamata | 2/424 |
| 5,091,997 | 3/1992 | Foehl | 2/424 |

*Primary Examiner*—Peter Nerbun

*Attorney, Agent, or Firm*—James V. Tura; James B. Bechtel; Susan E. Verona

[57] ABSTRACT

Helmet visor support apparatus is provided which can move the visor between a raised and a lowered position by the operation of one hand. The apparatus comprises a visor support arm pivotally attached to the helmet at a pivot point for moving the visor between the raised and lowered positions. A positioning means is attached to the helmet at the pivot point and has at least two bores corresponding to the raised and lowered visor positions. A locking pin retractably engages either one of the bores in the positioning means to lock the visor support arm in position. A spring coiled around the locking pin normally biases the locking pin in engagement with one of the bores. A manually activatable retracting means is attached to the locking pin for retracting the locking pin from the one of the bores upon being manually activated, thereby allowing the visor support arm to pivot. The retracting means is supported on the visor support arm between the two ends thereof and is positioned to be activated by manual movement away from the pivot point and towards the visor.

16 Claims, 6 Drawing Sheets 32
34
10
36
42a
40
70
12
46
72a
58a
30
54
42b
58b
44
72b
48
70
52
20
14
16
38
50
24
56
28
68
64
22
18
60
62
66

10
12
26a
18a
14
16a 12
14
10
72a
30
58a
42b
42a
40
32
70
58b
44
48
52
38
28
26
60
70
50
54
72b
22
46
32
62
56
16
64
18

14
12
10
58a
72a
54
42a
40
52
32
60
44
70
30
58b
22
38
28
26
48
62
56
50
70
66
42b
46
32
72b
64
16
18

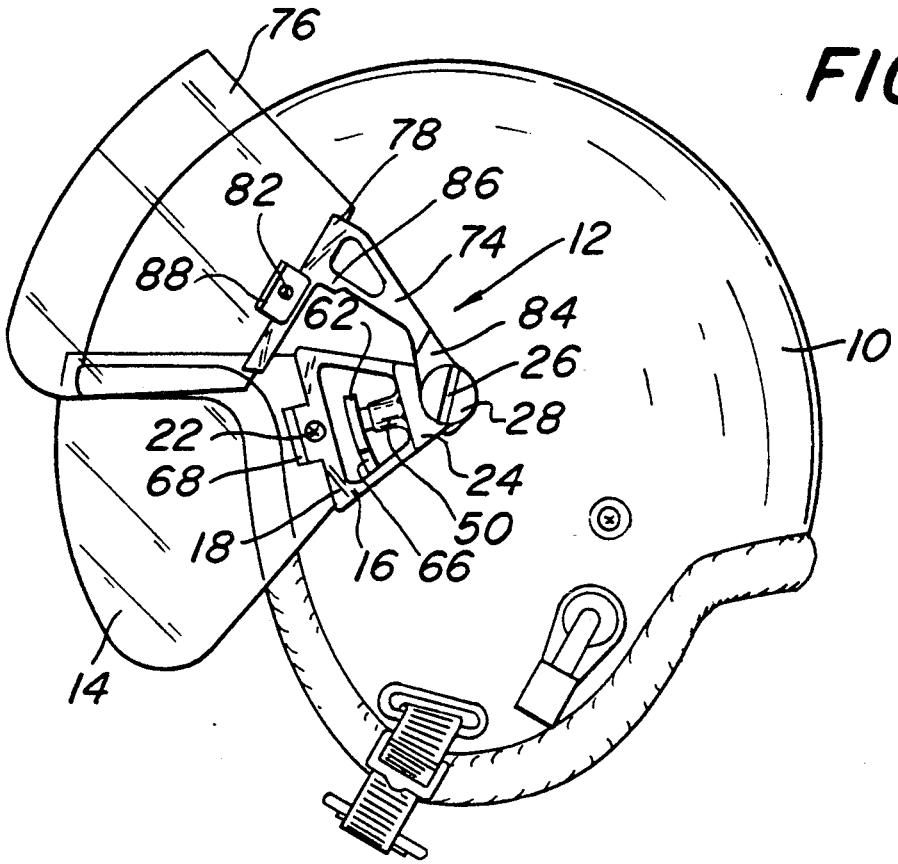
FIG. 7
FIG. 9
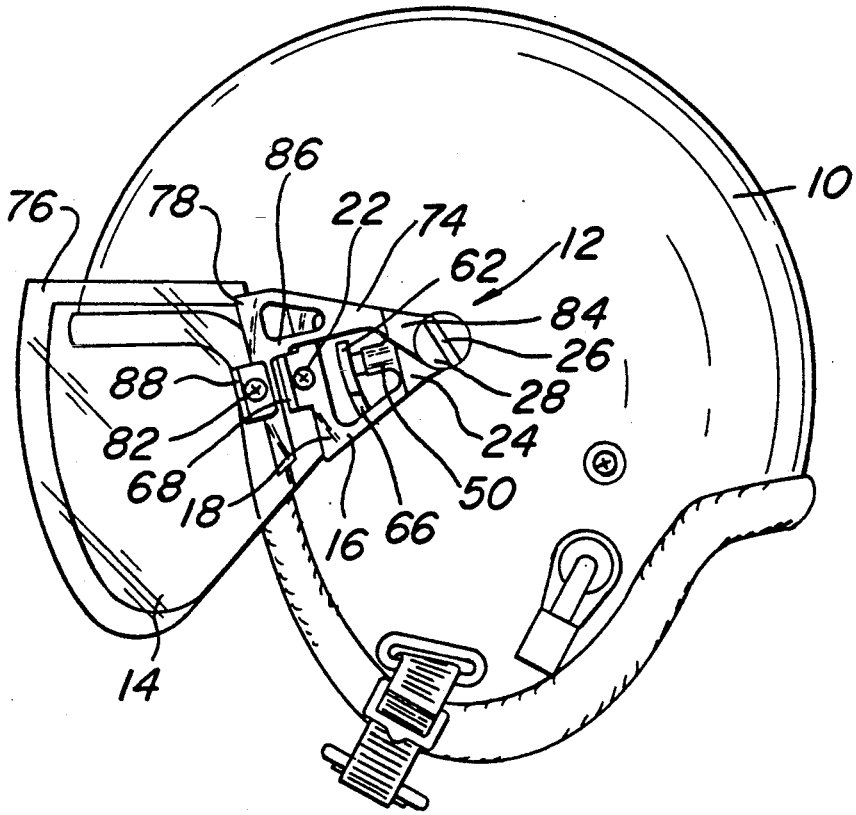

78
88
82
76
86
80
74
10
34
36
84
12
32
42a
72a
46
70
58a
54
40
30
44
42b
58b
16
48
70
72
52
14
50
38
56
24
28
68
64
22
20
18
60
62
66

HELMET VISOR SUPPORT APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to helmet visor support apparatus and more particularly to such apparatus for adjusting a helmet visor or visors between raised and lowered positions with just one hand.

An aircraft pilot's helmet generally has a visor for protecting the pilot's face and eyes from wind blast and debris during ejection. The visor is generally movable between a lowered position over the face and a raised position above the helmet. It is important to the pilot's safety that the visor remain locked in position over the face when the pilot is subjected to windblast. The pilot must be able to easily move the visor between the raised and lowered positions, as well as easily positively lock it in one of these positions. In fact, the pilot should be able to move and lock the visor with one hand, since he needs the other hand to fly the aircraft. Additionally, the raised and lowered positions should be adjustable to an individual pilot's needs. Many pilot helmets have two visors, which should be movable either independently of one another or as a unit, with one hand.

Visor moving and locking mechanisms have the additional limitation that they should be operable without interfering with other maneuvers and apparatus used by the pilot. For example, if the parachute shroud lines were to become entangled on the helmet during parachute deployment, the pilot's neck could be seriously injured. During high-G maneuvers, when the pilot's head is forced against the ejection seat, his head must be free to move against the seat without interference. Additionally, the mechanism must not interfere with easy installation of the visor.

SUMMARY OF THE INVENTION

It is therefore a general object of the invention to provide support apparatus for a helmet visor.

It is a more specific object to provide support apparatus which moves the visor between raised and lowered positions and positively locks the visor in either of these positions.

It is a further object to provide support apparatus for a helmet visor which requires minimal and easy manipulation by the pilot to move and lock the visor.

It is still another object to provide such apparatus which has one-handed activation.

It is yet another object to provide helmet visor moving and locking apparatus which is operable with one hand and does not interfere with shroud lines.

It is another object to provide helmet visor support apparatus with raised and lowered positions which are adjustable to the individual pilot's needs.

Other objects include providing ease of installation of the visor into the visor support apparatus, and ease of movement of both of the visors together or independently of each other.

These and other objects are accomplished by helmet visor support apparatus comprising a visor support arm having an attachment end and a visor-holding end, pivotally attached at the attachment end to the helmet at a pivot point, for moving the visor between a raised and a lowered position. A positioning means is attached to the helmet at the pivot point, and has at least two bores corresponding to the raised and lowered visor positions. A locking pin for retractably engaging either one of the bores in the positioning means is operatively connected to lock the visor support arm in position when so engaged. A biasing means is operatively connected to the visor support arm to normally bias the locking pin in engagement with one of the bores. A manually activatable retracting means is attached to the locking pin and operatively connected to release the biasing means and retract the locking pin from the one of the bores upon being manually activated, thereby allowing the visor support arm to pivot. The retracting means is mounted on the visor support arm between the two ends thereof, and is positioned to be activated by manual movement away from the attachment end of the visor support arm and towards the visor holding end thereof.

Other objects, advantages and novel features will become apparent from the following detailed description of the invention when considered in conjunction with the accompanying drawings.

DESCRIPTION OF THE DRAWINGS

FIG. 7 is a side view of the helmet visor support apparatus of the invention being used with two visors, one in the raised and one in the lowered position.

FIG. 9 is a side view of the helmet visor support apparatus of FIG. 7 being used with two visors, both in the lowered position.

DESCRIPTION OF THE PREFERRED EMBODIMENT

Figure 1:
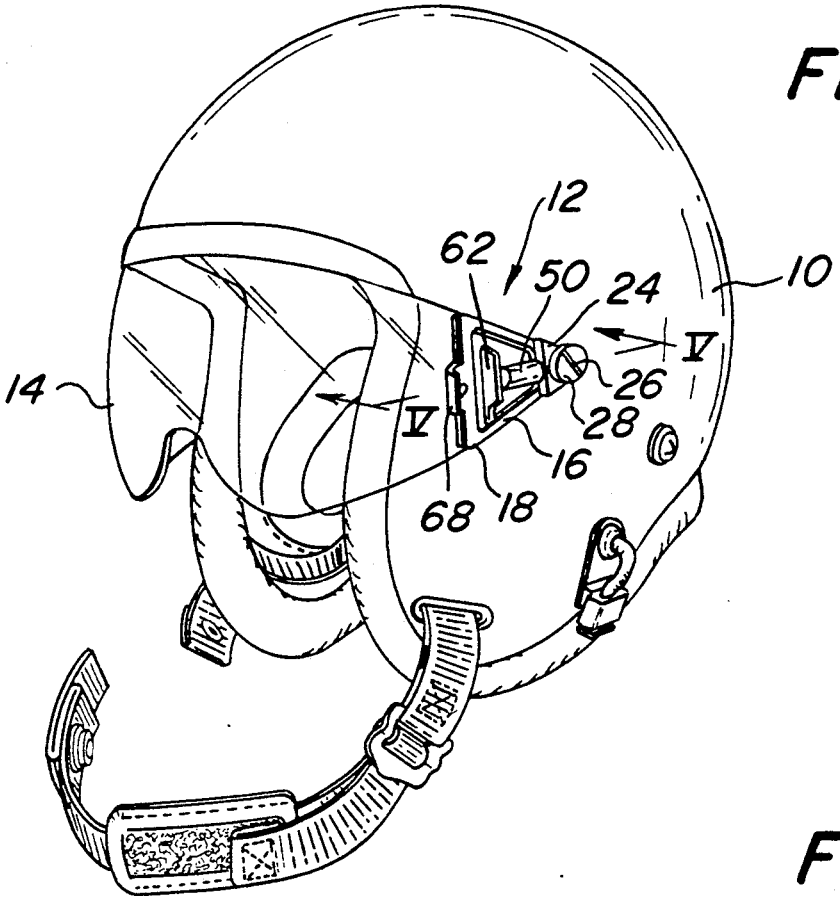
FIG. 1 is a perspective view of the helmet visor support apparatus of the present invention on a helmet.
Figure 2:
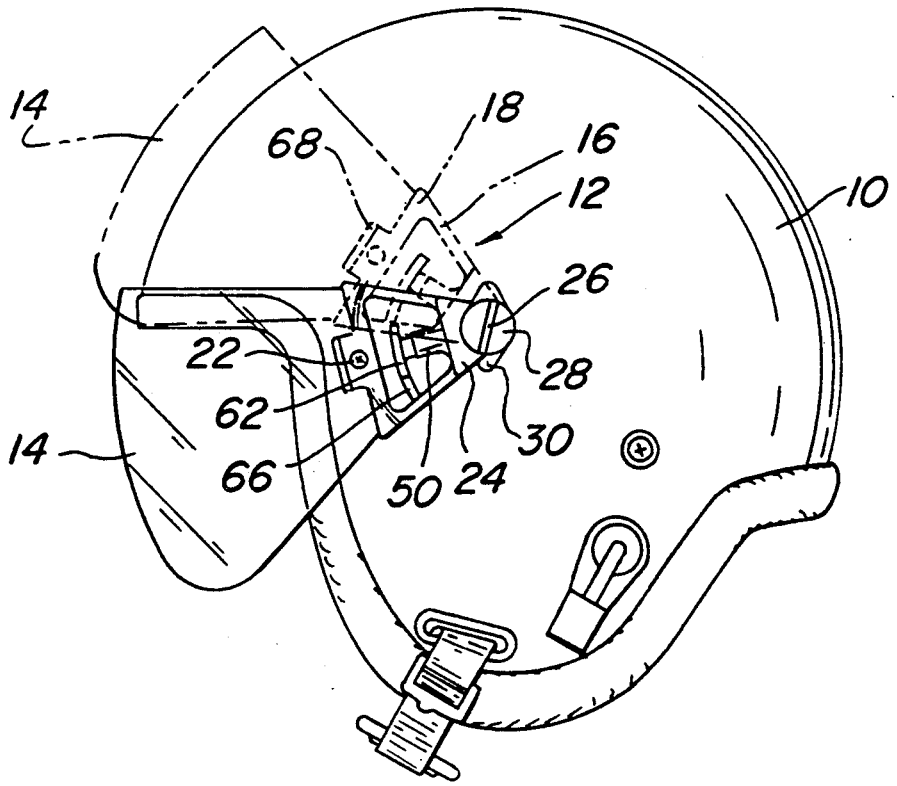
FIG. 2 is a side view of the helmet visor support apparatus shown in FIG. 1 illustrating the visor in the raised and lowered positions.
Figure 3:
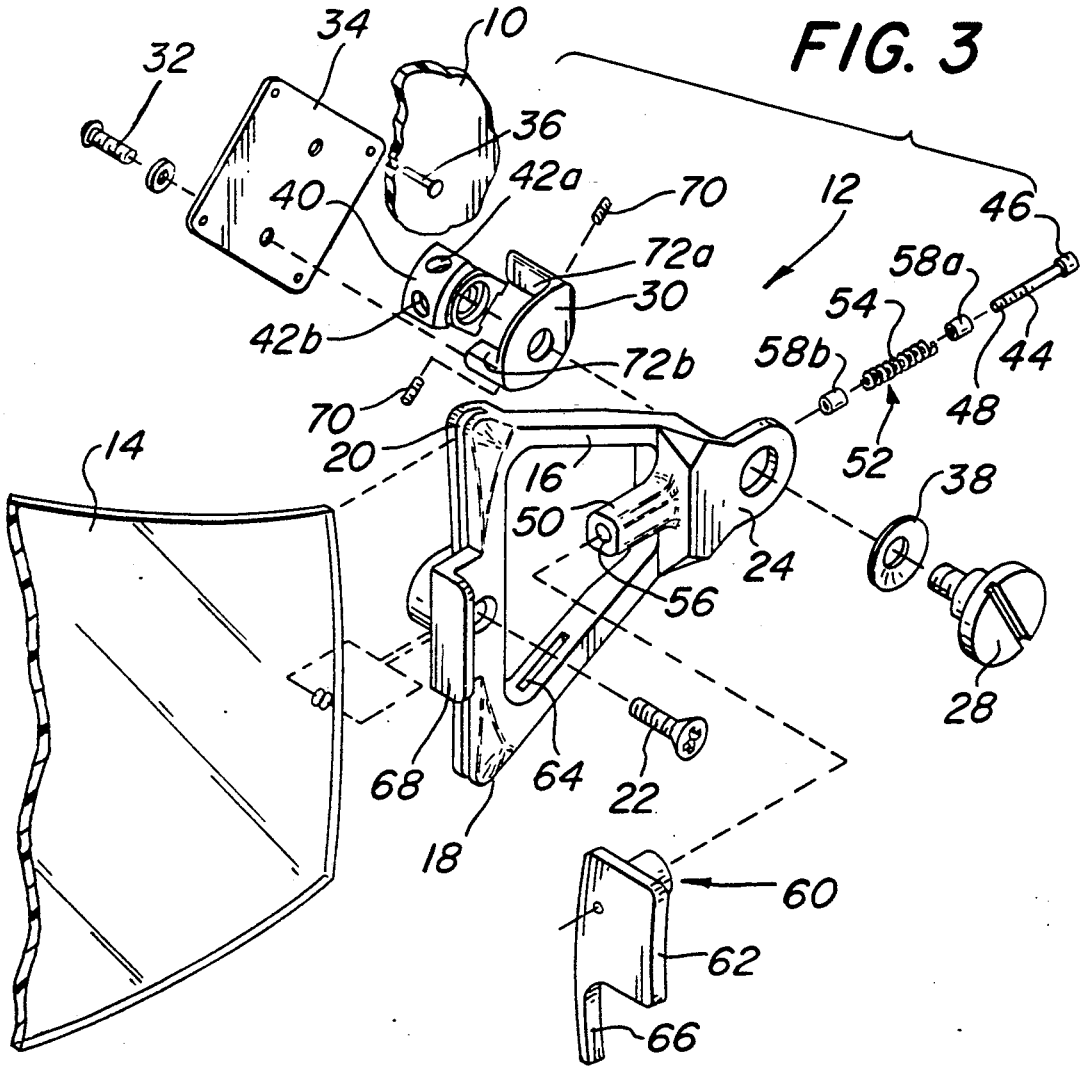
FIG. 3 is an exploded view of the helmet visor support apparatus of FIG. 1.

Referring now to the drawings wherein like characters designate like or corresponding parts throughout the several views, one sees in FIG. 1 a helmet 10 of the type generally worn by aircraft pilots, using the helmet visor support apparatus 12 of the present invention to support a single visor 14, shown here in the lowered position. Helmet visor support apparatus 12 includes a visor support arm 16 having a visor-holding end 18 to which visor 14 is attached. As shown in FIG. 3, visor-holding end 18 has a groove 20 along its edge into which the entire rim of visor 14 fits. At approximately the midpoint of the rim of visor 14 there is a hole which is alignable with a hole at approximately the midpoint of visor-holding end 18 of visor support arm 16. A screw 22 through the holes attaches visor 14 to visor support arm 16. Groove 20 provides support along the entire length of the rim of visor 14 to prevent movement of the visor with respect to visor support arm 16. Visor 14 is fixed to visor holding end 18 at only one location to provide for easy installation and detachment. Visor support arm 16 is pivotally attached at an attachment end 24 to helmet 10 at a pivot point 26, for moving visor 14 between a raised and a lowered position. FIG. 2 best illustrates how visor 14 is movable about pivot point 26 between a raised (shown in dotted lines) and a lowered (shown in solid line) position.

Visor support arm 16 is pivotally attached at attachment end 24 to helmet 10 at pivot point 26. Pivotal attachment of visor support arm 16 may be by such means as a shoulder screw head 28 through a hole in attachment end 24 and into a mount 30, which is rigidly fixed as by screws 32 to helmet 10 at pivot point 26. To distribute stresses, a bearing plate 34 may be screwed as by set screws 36 to the inside of helmet 10 for receiving screws 32. To provide sufficient friction to the pivotal movement of visor support arm 16, a curved spring washer 38 is installed between shoulder screw head 28 and the visor support arm. This provides some resistance to the movement and therefore gives the pilot more control over the visor's movement between the positions.

A positioning means 40 is attached to helmet 10 at pivot point 26. Positioning means 40 has at least two bores, 42*a* and 42*b*, corresponding to the raised and lowered visor positions. Each bore 42 is colinear with a line through pivot point 26 and opens towards visor-holding end 18 of visor support arm 16. Positioning means 40 is a rigid piece having an arcuate surface which forms part of a circle which has its center at pivot point 26. Bores 42*a* and 42*b* extend from the surface radially towards pivot point 26. Positioning means 40 has a threaded hole for receiving shoulder screw head 28.

Figure 5:
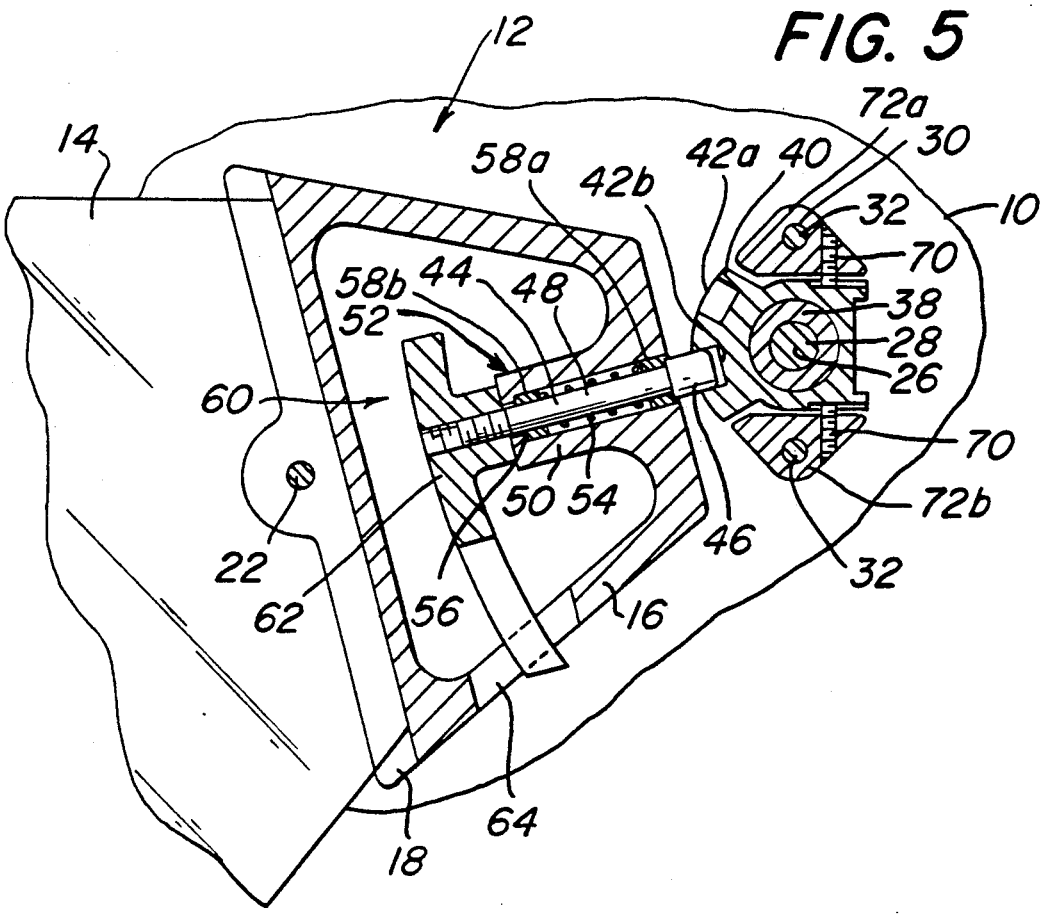
FIG. 5 is a cross-sectional view of the helmet visor support apparatus taken along the line V—V of FIG. 1, illustrating the visor locked into the lowered position.

As shown in FIG. 5, a locking pin 44 for retractably engaging either one of bores 42*a* or 42*b* in positioning means 40 is connected to lock visor support arm 16 in position when so engaged. Locking pin 44 further comprises a head 46 at one end thereof which has a diameter sized to engage bores 42*a* and 42*b*, and a stem 48, at the other end thereof, which has a diameter smaller than that of the head. A hollow, generally cylindrical encasement 50 is fixed to visor support arm 16 and is sized to closely encase locking pin 44 therewithin. In this way, when locking pin 44 is engaged in one of bores 42, visor support arm 16 is unable to pivot about pivot point 26, thereby locking visor 14 in position.

A biasing means 52 is operatively connected to visor support arm 16 to normally bias locking pin 44 in engagement with one of bores 42*a* and 42*b*. Biasing means 52 comprises a spring 54 coiled around stem 48 of locking pin 44. Spring 54 has a diameter less than or equal to the diameter of head 46 of locking pin 44. An inner rim 56 is fixed to one end of encasement 50 to urge spring 54 against head 46 of locking pin 44. Inner rim 56 is sized to provide a circular hole having a diameter which is smaller than the diameter of spring 54, through which stem 48 can slide.

A first and a second hollow, ring-shaped slipper 58*a* and 58*b* are provided for keeping locking pin 44 aligned within encasement 50. First slipper 58*a* is slidably positioned around stem 48 of locking pin 44 abutting head 46 of the locking pin and second slipper 58*b* is slidably positioned around the stem of the locking pin abutting inner rim 56. First and second slippers 58*a* and 58*b* have outer diameters greater than or equal to that of spring 54 and slightly less than that of cylindrical encasement 50.

Figure 6:
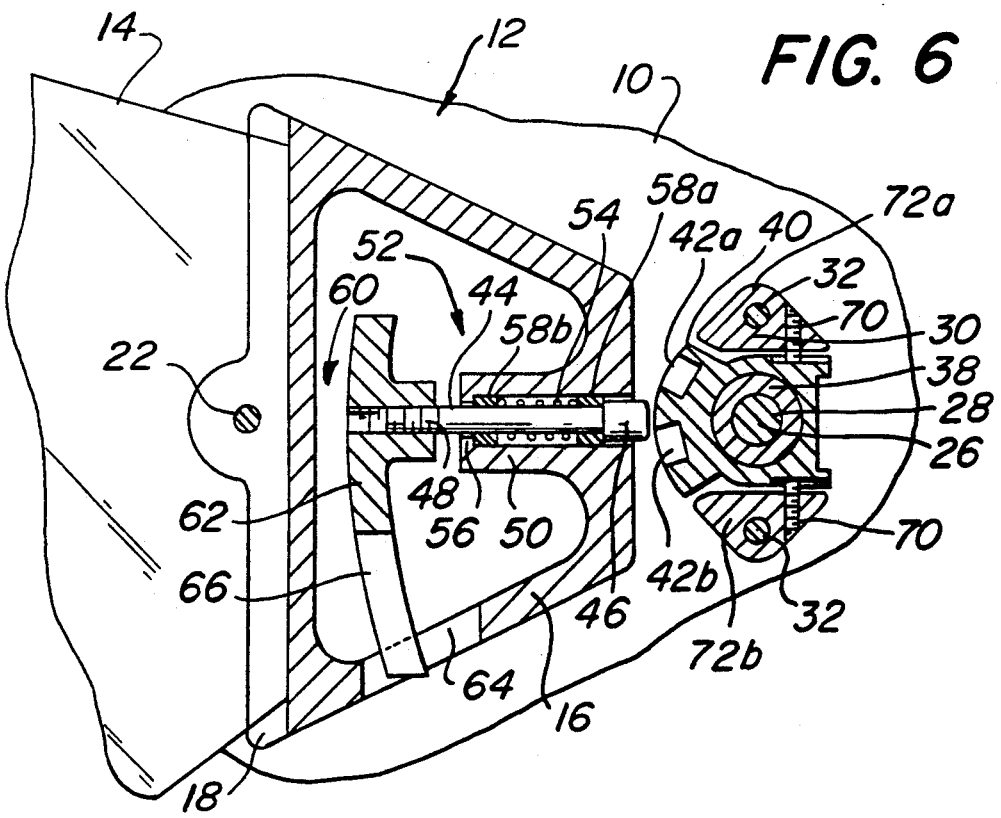
FIG. 6 is a cross-sectional view of the helmet visor support apparatus shown in FIG. 5 illustrating the visor positioned between the raised and lowered positions with the retracting means activated.

A retracting means 60 is attached to stem 48 of locking pin 44 and operatively connected to release biasing means 52 and retract locking pin 44 from the one of bores 42, thereby allowing visor support arm 16 to pivot. Retracting means 60 is mounted on visor support arm 16 between pivot point 26 and visor 14, and therefore no part of it extends behind the pilot's ear. Activation is by manual movement away from attachment end 24 of visor support arm 16 and towards visor-holding end 18 thereof for ease of operation. Retracting means 60 includes a handle 62 attached to locking pin 44 and extending outwardly from helmet 10 for easy engagement by the pilot's thumb. Stem 48 slides through the circular hole formed by inner rim 56 when retracting means 60 is activated. Spring 54 compresses against inner rim 56 when handle 62 is pulled toward attachment end 24, thereby removing the normally biased locking pin 44 from one of bores 42*a* or 42*b*. FIG. 6 shows retracting means 60 activated, and locking pin 44 retracted from b ores 42*a* and 42*b*. Visor 14 is positioned between the raised and lowered positions. Visor support arm 16 has a slot 64 therethrough, through which a tab 66, extending downwardly from handle 62, slides when the handle moves during activation. This prevents rotation of retracting means 60 and locking pin 44 about the axis of the locking pin. As best shown in FIGS. 1 and 3, visor support arm 16 further comprises a lip 68 fixed to visor-holding end 18 and positioned oppositely to handle 62 to provide an opposing surface for gripping during manual activation.

Positioning means 40 may be rotatably attached to helmet 10 at pivot point 26 via mount 30. As discussed above, mount 30 is positioned at pivot point 26 between attachment end 24 and helmet 10. Positioning means 40 is then rotatably fixed directly to mount 30 by set screws 70 as shown in FIGS. 3 and 5. This feature allows the raised and lowered visor positions to be preselected and adjusted according to the individual pilot's needs and then set fixedly into place with set screws 70. Mount 30 has a predominantly flat surface against which visor support arm 16 is disposed, and has a hole therethrough which is aligned with the hole in attachment end 24 through which shoulder screw head 28 extends. Mount 30 has a generally hollow area between the flat surface and helmet 10, which hollow area is large enough to accommodate positioning means 40 therein. Mount 30 has legs 72*a* and 72*b* for attachment to helmet 10 and through which set screws 70 extend for contacting positioning means 32.

Figure 4:
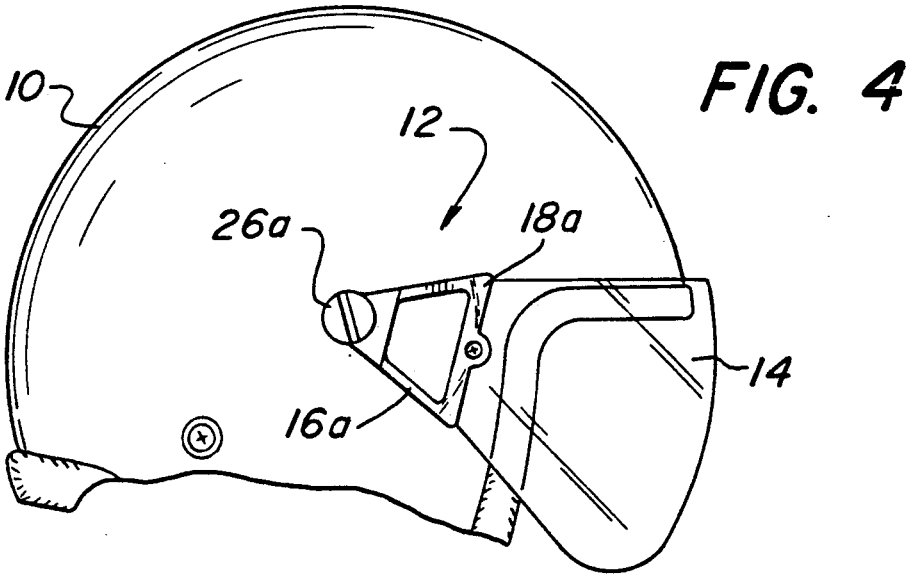
FIG. 4 is a side view of the helmet visor support apparatus of FIG. 1 from the opposite side of the helmet as shown in FIG. 2.

FIGS. 1–3 illustrate helmet visor support apparatus 12 from the left side of helmet 10. FIG. 4 illustrates the right side of support apparatus 12, which includes a visor support arm 16*a* pivotally attached at a pivot point 26*a* to helmet 10, and attached at a visor-holding end 18*a* to visor 14 along the right rim thereof. Visor support arm 16*a* pivots passively with the pivotal movement of visor support arm 16.

Figure 8:
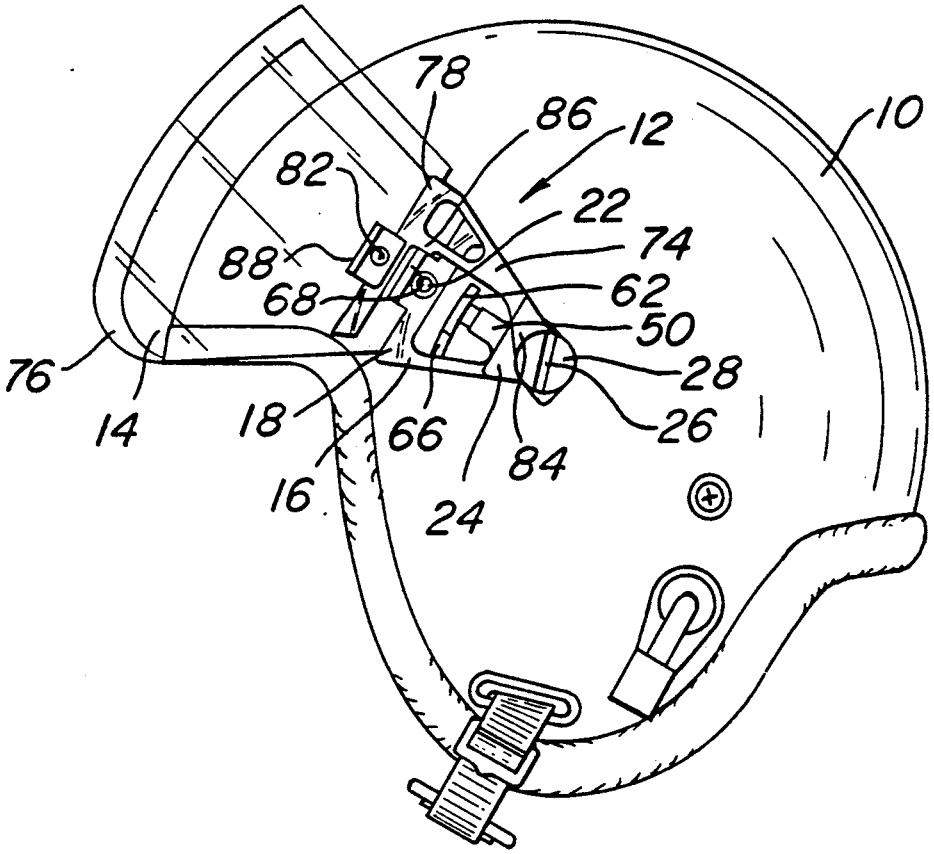
FIG. 8 is a side view of the helmet visor support apparatus shown in FIG. 7 being used with two visors, both in the raised position.
Figure 10:
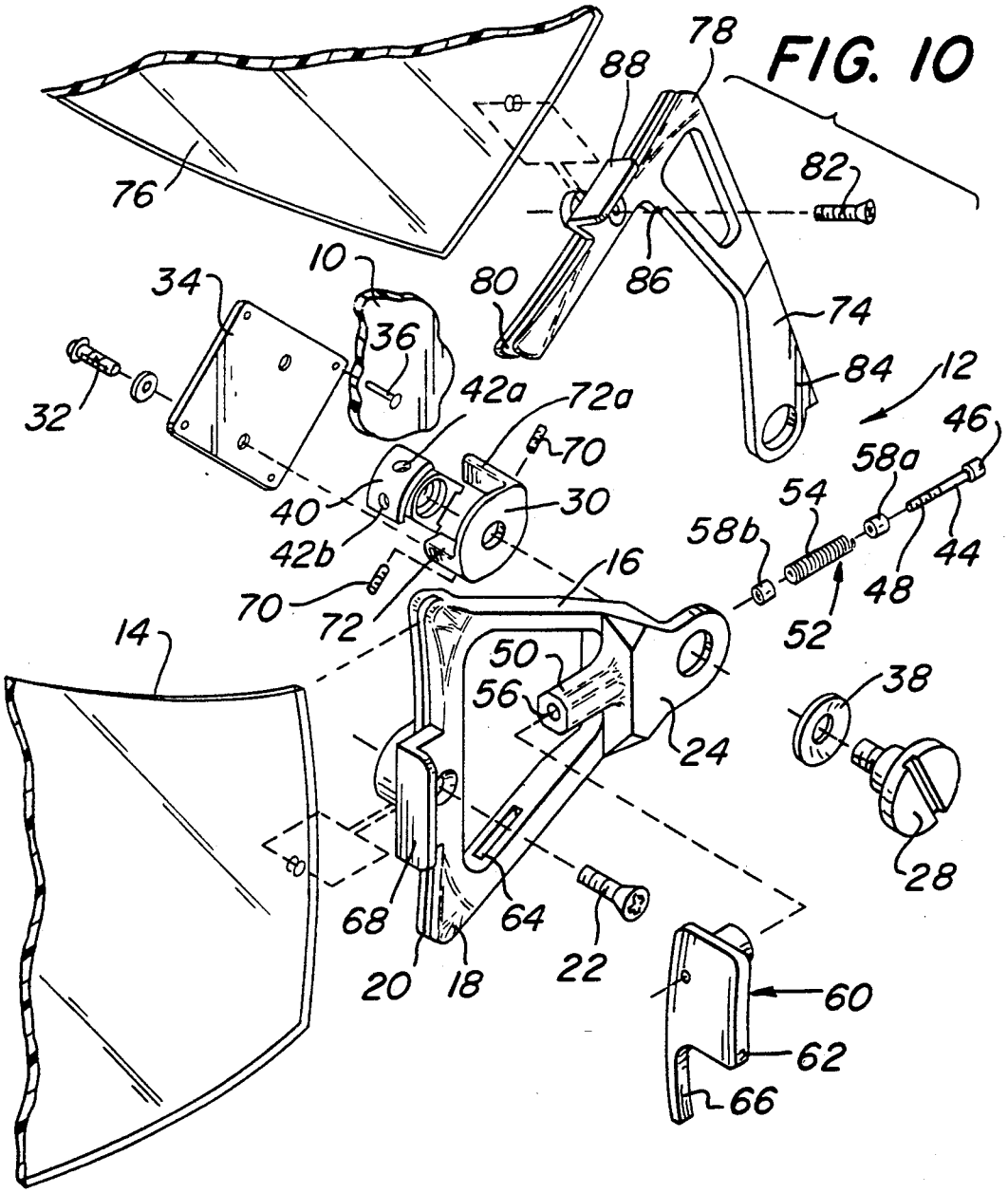
FIG. 10 is an exploded view of the helmet visor support apparatus of FIG. 7 illustrating the invention being used with two visors.

FIGS. 7–9 show an additional outer visor support arm 74 for supporting an outer visor 76. FIG. 7 shows visor 14 in the lowered position and outer visor 76 in the raised position, FIG. 8 shows both visors in the raised position, and FIG. 9 shows both visors in the lowered position. Outer visor support arm 74 has an outer visor-holding end 78 and a groove 80 therein for receiving the rim of outer visor 76 therein. Outer visor 76 is fixed to outer visor support arm 74 by screw 82. Outer visor support arm 74 is pivotally attached at an attachment end 84 to pivot point 26 between visor support arm 16 and curved spring washer 38. Outer visor support arm 74 is longer than visor support arm 16, so that outer visor 76 fits over the outer surface of visor 14. A ledge 86 on outer visor support arm 74 abuts lip 68 of visor support arm 16 to prevent outer visor 76 from pivoting further downward than visor 14. Outer visor support arm 74 has an outer lip 88 on outer visor-holding end 78, which, when visors 14 and 76 are in the same position, is opposite handle 62, and serves as a gripping surface for the outer visor support arm. Friction, provided by curved spring washer 38, holds outer visor support arm 74 in the raised position when visor support arm 16 is in the lower position. When the two visor support arms 16 and 74 are to be moved jointly, outer visor support arm 74 moves passively with visor support arm 16. Outer visor 76 is attached to the right side of helmet 10 (not shown) in the same manner.

Some of the many advantages of the invention should now be readily apparent. For instance, helmet visor support apparatus has been provided which allows a pilot to move the visor between raised and lowered positions and positively lock the visor in position with one hand. Furthermore, the apparatus does not extend behind the pilot's ear and therefore will not entangle shroud lines.

Those skilled in the art will appreciate without any further explanation that many modifications and variations are possible to the above disclosed helmet visor support apparatus, within the concept of this invention. Consequently, it should be understood that all such modifications and variations fall within the scope of the following claims.

What is claimed is:

1. Helmet visor support apparatus, comprising:

a visor support arm having an attachment end and a visor-holding end, pivotally attached at the attachment end to a helmet at a pivot point, for moving the visor between a raised and a lowered position;

a positioning means attached to the helmet at the pivot point, said positioning means having at least two bores corresponding to the raised and lowered visor positions;

a locking pin for retractably engaging either one of the bores in said positioning means, and operatively connected to lock said visor support arm in position when so engaged;

a biasing means operatively connected to said visor support arm to normally bias the locking pin in engagement with one of the bores; and a manually activatable retracting means attached to said locking pin and operatively connected to release said biasing means and retract said locking pin from the one of the bores upon being manually activated thereby allowing said visor support arm to pivot, said retracting means comprising a handle mounted on said visor support arm between the two ends thereof and positioned to be activated by manual movement away from the attachment end of said visor support arm and towards the visor-holding end thereof, and a lip fixed to the visor-holding end of said visor support arm and positioning oppositely to said handle, to provide an opposing surface for gripping during manual activation.

2. The helmet visor support apparatus of claim 1, further comprising a hollow, generally cylindrical encasement fixed to said visor support arm and sized to closely encase said locking pin therewithin, whereby said locking pin is operatively connected to lock said visor support arm in position when said locking pin is engaged in one of the bores.

3. The helmet visor support apparatus of claim 1, further comprising a first and a second hollow, ring-shaped slipper for keeping said locking pin aligned within said encasement, said first slipper slidably positioned around said stem of said locking pin abutting said head of said locking pin, and said second slipper slidably positioned around said stem of said locking pin abutting said inner rim, said first and second slippers having outer diameters greater than or equal to that of said spring and slightly less than that of said cylindrical encasement.

4. The helmet visor support apparatus of claim 1, wherein said manually activatable retracting means further comprises a narrow tab extending from said handle and oriented to slidably fit through a slot in said visor support arm, for preventing rotation of said locking pin.

5. The helmet visor support apparatus of claim 1, further comprising a curved spring washer rotatably fixed to the helmet at the pivot point for providing sufficient friction for controllably moving the visor between the raised and lowered positions.

6. The helmet visor support apparatus of claim 1, further comprising a mount fixed to the helmet to which said positioning means is rotatably mounted.

7. The helmet visor support apparatus of claim 6, further comprising means connected to said mount for holding said positioning means at a preselected rotational position.

8. The helmet visor support apparatus of claim 1, wherein said positioning means comprises a rigid piece having an arcuate surface into which the bores extend radially towards the pivot point.

9. The helmet visor support apparatus of claim 1, wherein the visor-holding end of said visor support arm has a groove along the edge thereof for receiving the entire side rim of the visor.

10. The helmet visor support apparatus of claim 9, further comprising means for fixing the visor in the groove at a single location.

11. The helmet visor support apparatus of claim 1, further comprising an outer visor support arm for supporting an outer visor, pivotally mounted to the helmet at the pivot point.

12. The helmet visor support apparatus of claim 11, wherein said outer visor support arm comprises a ledge for abutting said visor support arm to prevent the further downward rotation of the outer visor.

13. The helmet visor support apparatus of claim 1, further comprising a passive visor support arm pivotally mounted to the helmet on the opposite side thereof as the said visor support arm.

14. Helmet visor support apparatus, comprising:

a visor support arm having an attachment end and a visor-holding end, pivotally attached at the attachment end to the helmet at a pivot point, for moving the visor between a raised and a lowered position;

a positioning means rotatably attached to the helmet at the pivot point, said positioning means having at least two bores extending thereinto corresponding to the raised and lowered positions;

a locking pin for retractably engaging either one of the bores in said poisitioning means, said locking pin comprising a head at one end thereof which has a diameter sized to engage the bores, and a stem which has a diameter smaller than that of said head;

a hollow, generally cylindrical encasement fixed to said visor support arm and sized to closely encase said locking pin therwithin, whereby said locking pin is operatively connected to lock said visor support arm in position when said locking pin is engaged in one of the bores;

a spring coiled around said stem and having a diameter less than or equal to the diameter of said head;

an inner rim fixed to one end of said cylindrical encasement to urge said spring against said head of said locking pin, said inner rim being sized to provide a circular hole through which said stem slidably fits;

a handle attached to said locking pin for retracting said locking pin from the one of the bores, thereby allowing said visor support arm to pivot;

a narrow tab extending from said handle and oriented to slidably fit through a slot in said visor support arm, for preventing rotation of said locking pin; and a curved spring washer rotatably fixed to the helmet at the pivot point for providing sufficient friction for controllably moving the visor between the raised and lowered positions.

15. Helmet visor support apparatus, comprising:

a visor support arm having an attachment end and a visor-holding end, pivotally attached at the attachment end to a helmet at a pivot point, for moving the visor between a raised and a lowered position;

a positioning means attached to the helmet at the pivot point, said positioning means having at least two bores corresponding to the raised and lowered visor positions;

a locking pin for retractably engaging either one of the bores in said positioning means, and operatively connected to lock said visor support arm in position when so engaged, said locking pin comprising a head at one end thereof which has a diameter sized to engage the bores, and a stem which has a diameter smaller than that of said head;

a hollow, generally cylindrical encasement fixed to said visor support arm and sized to closely encase said locking pin therewithin, whereby said locking pin is operatively connected to lock said visor support arm in position when said locking pin is engaged in one of the bores;

a biasing means operatively connected to said visor support arm to normally bias the locking pin in engagement with one of the bores, said biasing means comprising a spring coiled around said stem of said locking pin and having a diameter less than or equal to the diameter of said head, and an inner rim fixed to one end of said cylindrical encasement to urge said spring against said head of said locking pin; and a manually activatable retracting means attached to said locking pin and operatively connected to release said biasing means and retract said locking pin from the one of the bores upon being manually activated thereby allowing said visor support arm to pivot, said retracting means being mounted on said visor support arm between the two ends thereof and positioned to be activated by manual movement away from the attachment end of said visor support arm and towards the visor-holding end thereof.

16. The helmet visor support apparatus of claim 15, wherein said inner rim is sized to provide a circular hole having a diameter which is smaller than the diameter of said spring, through which said stem slides when said retracting means is activated.

* * * * *